US009879455B2

(12) United States Patent
White et al.

(10) Patent No.: US 9,879,455 B2
(45) Date of Patent: Jan. 30, 2018

(54) SLIP RESISTANT GLASS HINGE SYSTEM

(71) Applicants: Richard White, Camarillo, CA (US); Tom McGrath, Westlake Village, CA (US)

(72) Inventors: Richard White, Camarillo, CA (US); Tom McGrath, Westlake Village, CA (US)

( * ) Notice: Subject to any disclaimer, the term of this patent is extended or adjusted under 35 U.S.C. 154(b) by 0 days.

(21) Appl. No.: 14/887,314

(22) Filed: Oct. 19, 2015

(65) Prior Publication Data

US 2016/0108654 A1 Apr. 21, 2016

Related U.S. Application Data

(60) Provisional application No. 62/065,128, filed on Oct. 17, 2014.

(51) Int. Cl.
*E05D 5/00* (2006.01)
*E05D 5/02* (2006.01)

(52) U.S. Cl.
CPC .... *E05D 5/0246* (2013.01); *E05D 2005/0253* (2013.01); *E05Y 2900/114* (2013.01)

(58) Field of Classification Search
CPC ..... Y10T 16/5326
See application file for complete search history.

(56) References Cited

U.S. PATENT DOCUMENTS 1,915,448 A 10/1931 Ruth
2,154,716 A * 4/1939 Anderson ..... E05D 7/04 16/247
2,772,596 A * 12/1956 Trussell ..... B62D 17/00 188/196 M
3,229,323 A * 1/1966 Hensgen ..... E05D 7/04 16/247
3,871,283 A 3/1975 John
5,054,250 A * 10/1991 Foss ..... E06B 1/6069 254/104
8,431,757 B2 4/2013 Cheiky et al.
D689,757 S * 9/2013 Mukaide ..... D8/343
D709,352 S * 7/2014 Inoue ..... D8/343
D712,719 S * 9/2014 Inoue ..... D8/343
2014/0096450 A1 4/2014 Thompson
2014/0161709 A1 6/2014 Karthikeyan

FOREIGN PATENT DOCUMENTS

CA 2081247 4/1994
DE 3630234 A1 3/1988
EP 0176650 A2 4/1986
WO 2011097183 A2 8/2011
WO 2011143380 A2 11/2011

* cited by examiner

*Primary Examiner* — Victor Batson
*Assistant Examiner* — Matthew Sullivan
(74) *Attorney, Agent, or Firm* — Avyno Law P.C.

(57) ABSTRACT

A slip resistant hinge system for doors and, in particular, frameless glass doors, is provided. The hinge includes a dovetail-shaped central raised portion that minimizes or prevents the possibility of the glass slipping when secured to the hinge. The dovetail-shaped central raised portion can be designed as part of the hinge or can be created by inserts positioned around the central raised portion of the hinge. In operation, a corresponding dovetail-shaped opening is cut into the door for receiving the hinge.

5 Claims, 16 Drawing Sheets

SLIP RESISTANT GLASS HINGE SYSTEM

CROSS REFERENCE TO RELATED APPLICATIONS

This application claims priority of U.S. Provisional Application Ser. No. 62/065,128, filed on Oct. 17, 2014, titled SLIP RESISTANT GLASS HINGE, which application is incorporated by reference in this application in its entirety.

FIELD OF THE INVENTION

The present invention relates to a slip resistant hinge system for frameless glass doors.

BACKGROUND OF THE INVENTION

Frameless glass doors, such as those used in showers, are typically installed using metal hinges that are rectangular in shape. FIGS. 1*a* and 1*b* (Prior art) illustrates two ways in which notches are currently cut into frameless glass doors, such as shower doors to accommodate the metal hinges. FIG. 1*a* illustrates a simple rectangular notch 102 in a glass door 100, while FIG. 1*b* illustrates a rectangular notch with the inner opposing round corners 104 in the door 100 to better receive the corner fasteners of the hinge mechanism.

The hinges used in connection with the frameless glass doors contain two face plates, upon one of which may be a raised rectangular area containing the hinge mechanism itself. In operation, these raised areas are inserted into the rectangular notches cut into the glass plates of a shower door and support. The opposing face plates extend beyond the cut into the glass and are then secured to together. As such, the current art relies solely on clamping pressure from the face plates to keep the glass door from slipping out of its hinges. As a result, it is a common problem, when installing frameless glass doors like those used in heavy glass shower doors, to have the glass slip in the hinges, causing the door to loose proper alignment. In addition, glass doors, once installed, may also go out of alignment during use if undue pressure is applied to the door.

By way of example, FIG. 2 (Prior Art) illustrates one example of a glass door hinge 200 manufactured according to prior art, comprising a face plate 202, a raised central portion 204 having a rectangular shape and the hinge mechanism 206. As illustrated in FIG. 3 (Prior Art), the raised portion 204 on the face plate 202 is inserted into the opening 102, 104 in the glass door 100. The opening 102, 104 is sized such that the face plate 202 extends beyond the opening and sits flush against the face of the glass door 100. To secure the hinge 200 to the door 100, as illustrated in FIG. 4, fastener holes 404 in the face plate 402 are aligned with the fastener holes 406 in the corners of the raised portion 204 of the face plate 202. Face plate 402 is larger than the opening 104. When secured to the central raised portion 204, the face plates 202, 402 clamp the glass 100 between the face plates 202, 402. As such, clamping pressure from the face plates 202, 402 keep the glass door 100 from slipping out of the hinges 200. However, given the rectangular shape of the opening 102, 104 in the glass door 100 and the rectangular shape of the central raised portion 204 of the hinge 200, the central raised portion 204 of the hinge can slide out of the opening 102, 104 in the glass door if the clamping pressure between the plates 202 and 402 is compromised, cause slipping and/or the hinge 200 breaking from the door 100. Slipping can cause the door 100 to break by either falling off the hinge 200 or hitting an opposing glass panel. Accordingly, a need still exists for a slip-resistant or slip-minimizing hinge system.

SUMMARY

A system of preventing heavy glass doors, such as shower doors, from slipping in the hinges is provided. The system comprises a modified glass door hinge system that utilize dovetail cut in the glass door into which the modified hinge system is installed.

In one example of an implementation, a dovetail notch is cut into the glass for insertion of each hinge, and the raised central portion of one of the hinge pressure plates that inserts into the dovetail cut in the glass is itself dovetail-shaped.

In another example of an implementation, the glass door receives a dovetail cut for the insertion of each hinge, and a standard hinge is used; however, the shape of the raised central portion of one of the hinge pressure plates is modified by inserts of various types to produce the same effect as though that central portion were made in a dovetail shape.

A method is further provided that allows for securing and preserving the alignment of frameless glass doors, such as shower doors, during and after installation. The method comprises the steps of cutting each notch in the glass within which the door hinges are mounted in a dovetail shape, and fitting these notches with hinges that are either manufactured so that the portion of the hinge that is engaged within the notch is itself dovetail shaped, which portion is then engaged within the notch and secured by shims of even thickness, or alternatively is a hinge manufactured according to prior art, where the shape of the portion of the hinge that is engaged within the notch is modified to a dovetail shape using shims of uneven thickness, which modified portion is then engaged within the notch and secured by additional shims of even thickness.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

As illustrated in connection with FIGS. 5-16, the present invention provides a hinge system, particular useful in connection with frameless shower doors, that prevents or greatly reduces the possibility of the hinge slipping or falling out of the door. As will be illustrated below, the invention can be implemented in number of different ways; however, each way employs a dovetail opening or notch 500 cut into the door 100 into which a hinge 200 is to be mounted.

Figure 1B:
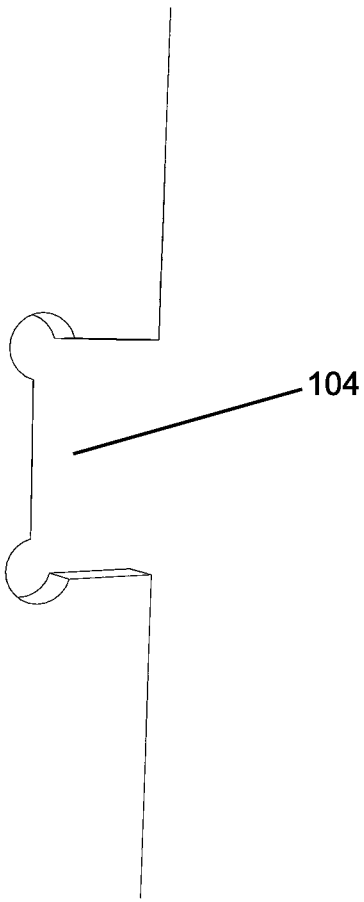
FIG. 1b PRIOR ART
FIG. 1*b* (Prior Art) is a side perspective view of an opening having rounded corners cut into a glass door for receiving a hinge in a frameless shower door assembly.
Figure 1A:
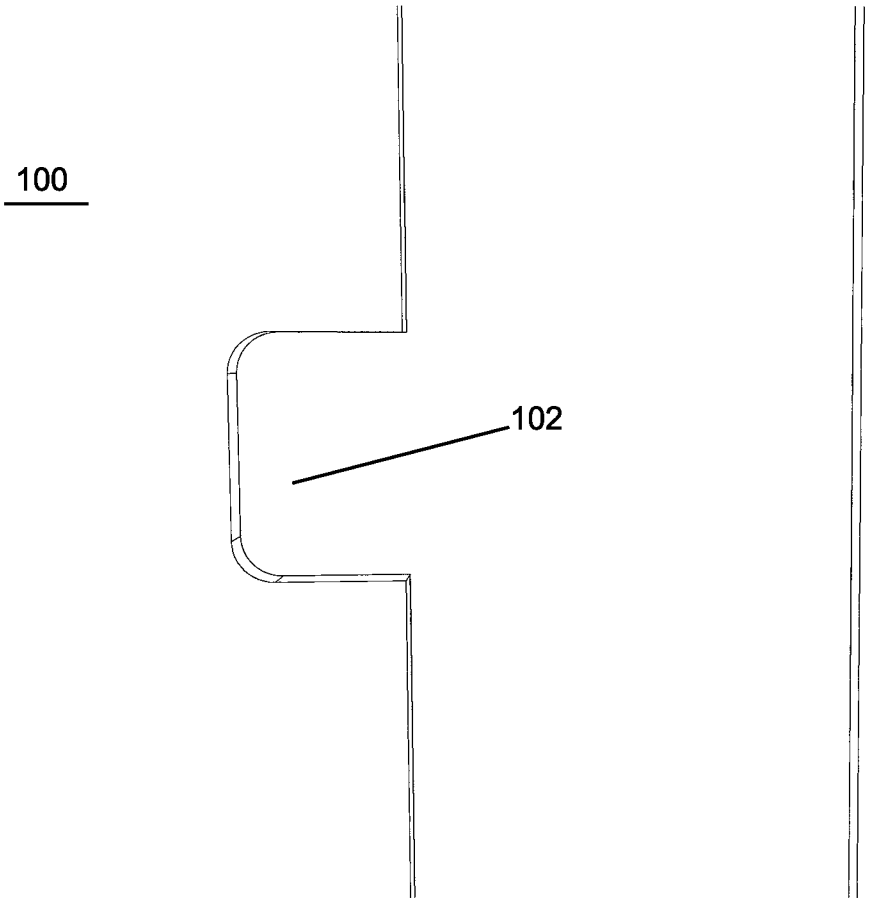
FIG. 1a PRIOR ART
FIG. 1*a* (Prior Art) is a side perspective view of an opening cut into a glass door for receiving a hinge in a frameless shower door assembly.
Figure 2:
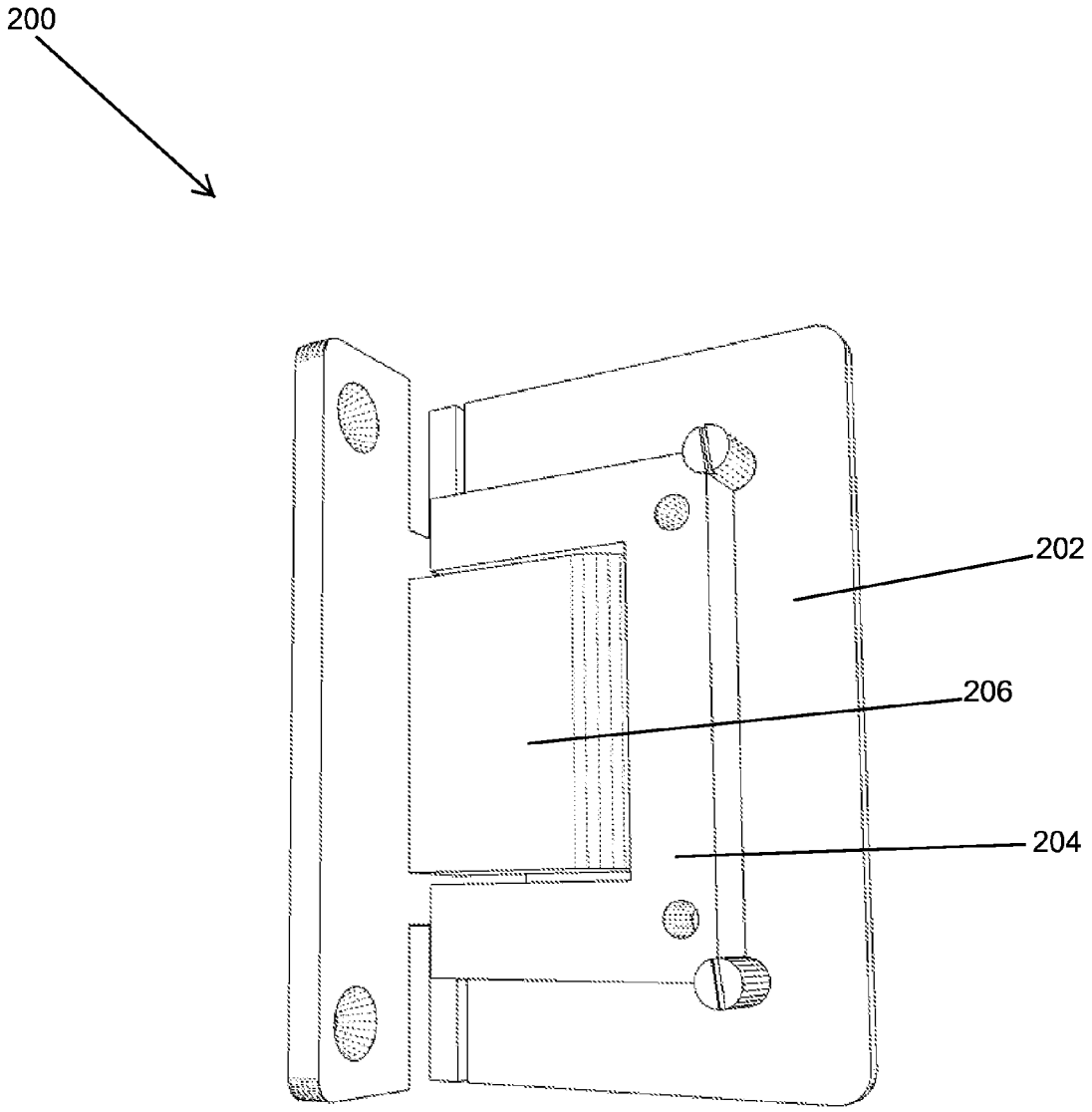
FIG. 2 PRIOR ART
FIG. 2 (Prior Art) is a side perspective view of an example of a hinge manufactured according to prior art.
Figure 3:
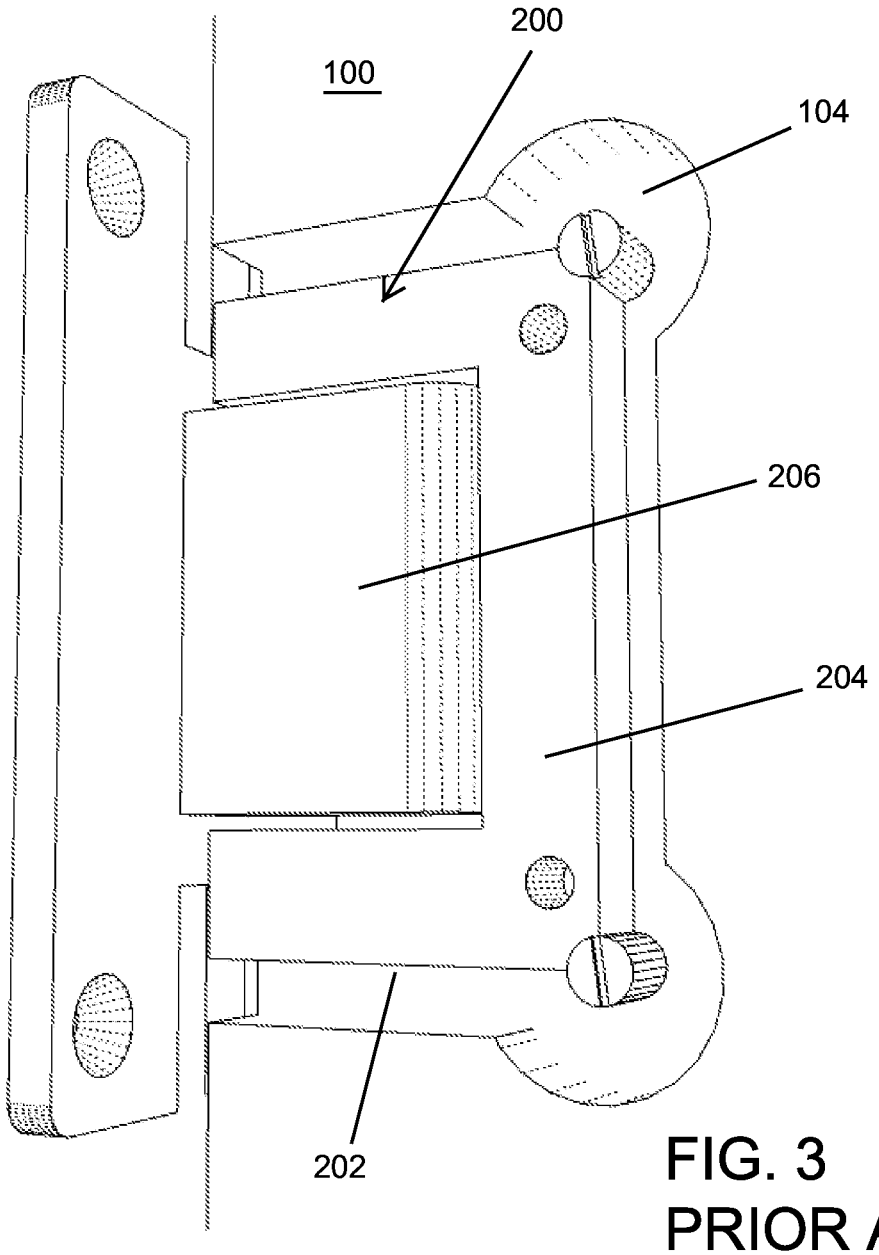
FIG. 3 PRIOR ART
FIG. 3 (Prior Art) is a side perspective view of hinge installation in a glass door according to prior art.
Figure 4:
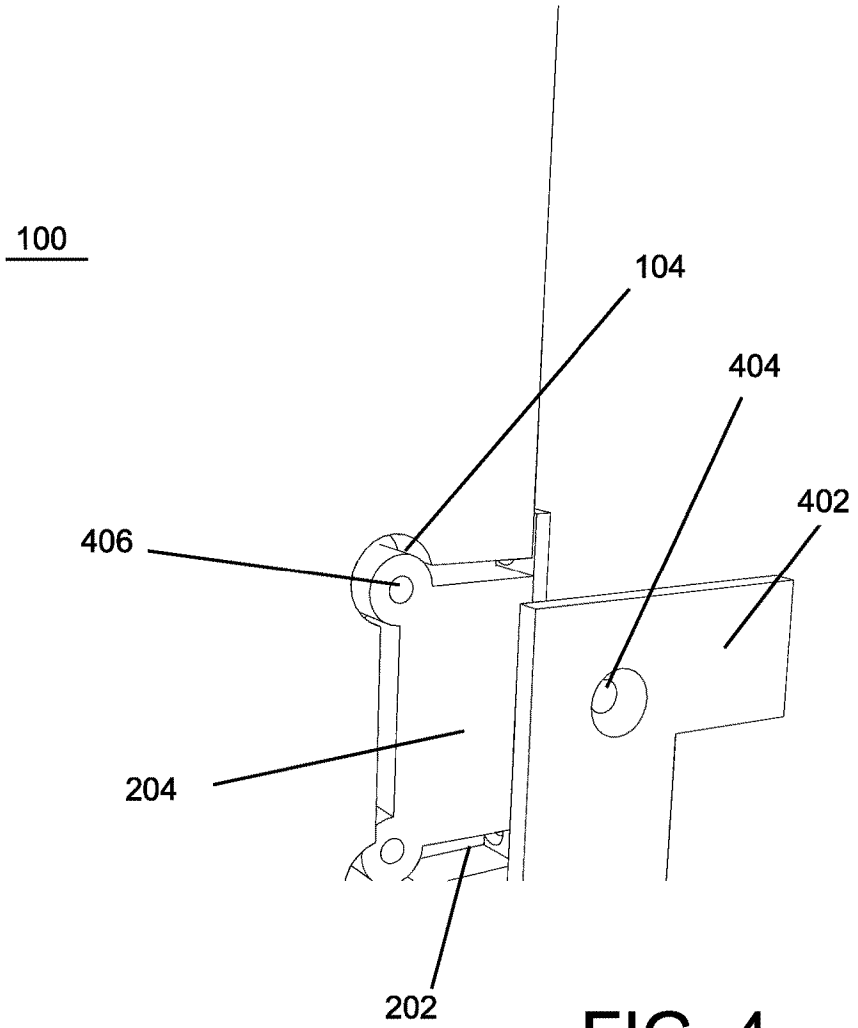
FIG. 4 PRIOR ART
FIG. 4 (Prior Art) is a side perspective view of a hinge manufactured according to prior art mounted within a notch cut into a glass door according to prior art.
Figure 5:
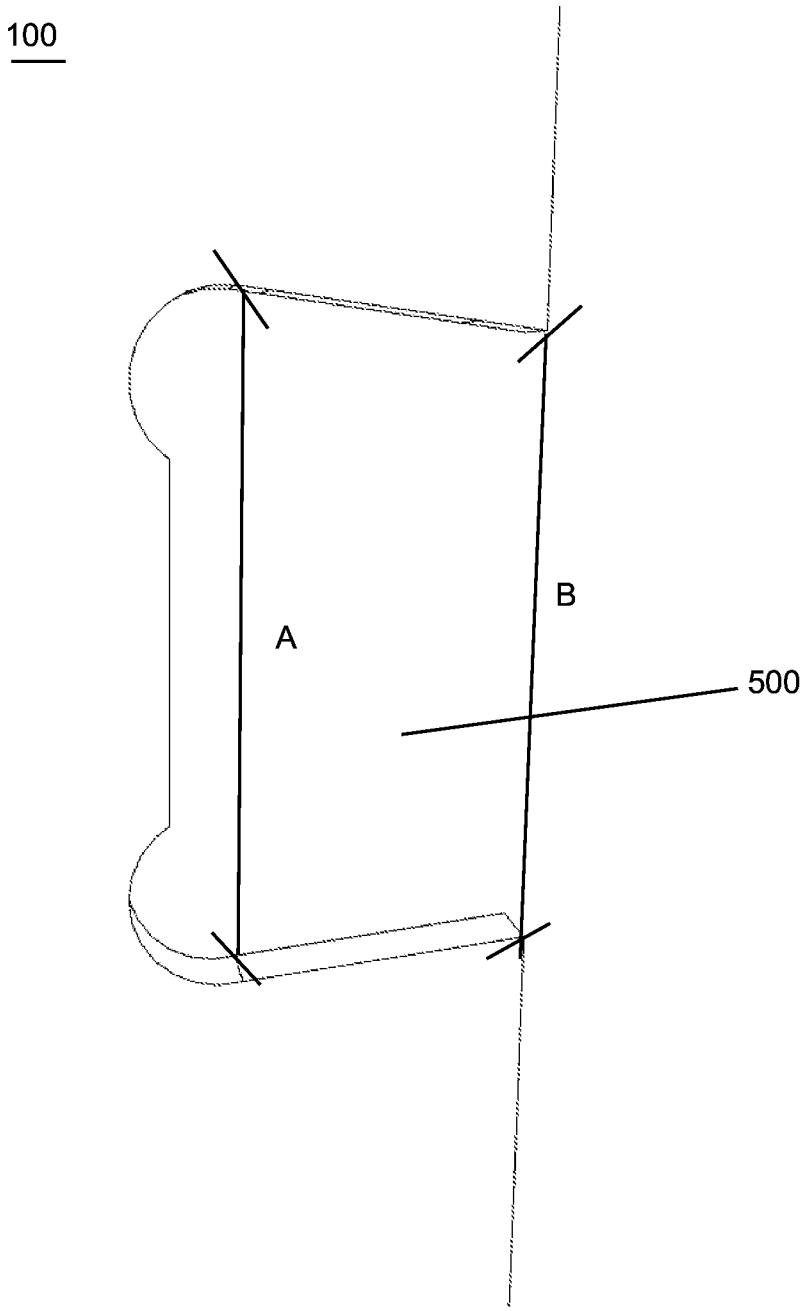
FIG. 5 is a side perspective view of a dovetail notch cut into a glass door.
Figure 6:
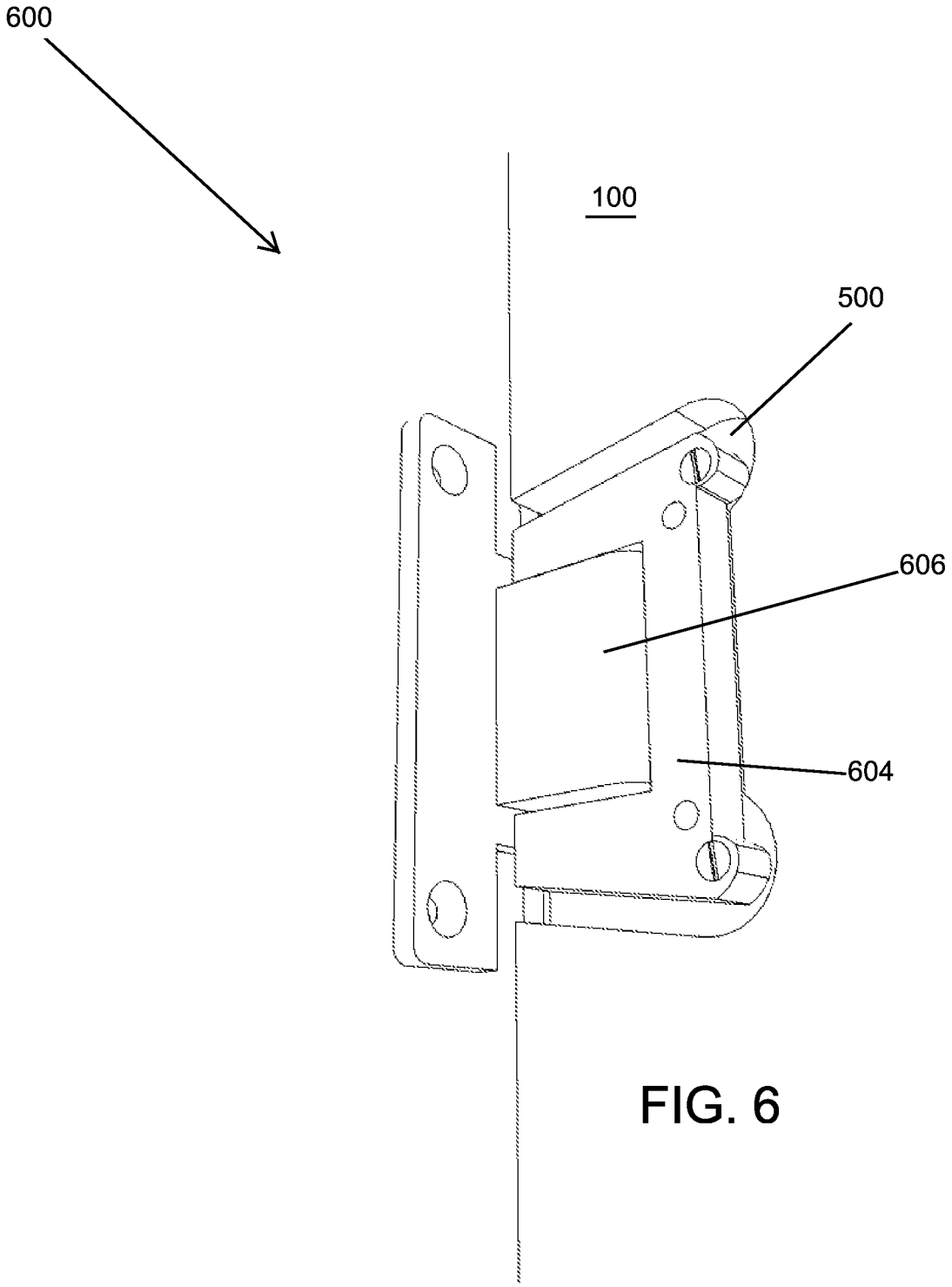
FIG. 6 is a side perspective view of a hinge with the central raised portion of one face plate containing the hinge mechanism made in a dovetail shape and engaged within a dovetail notch cut into a glass door.
Figure 7:
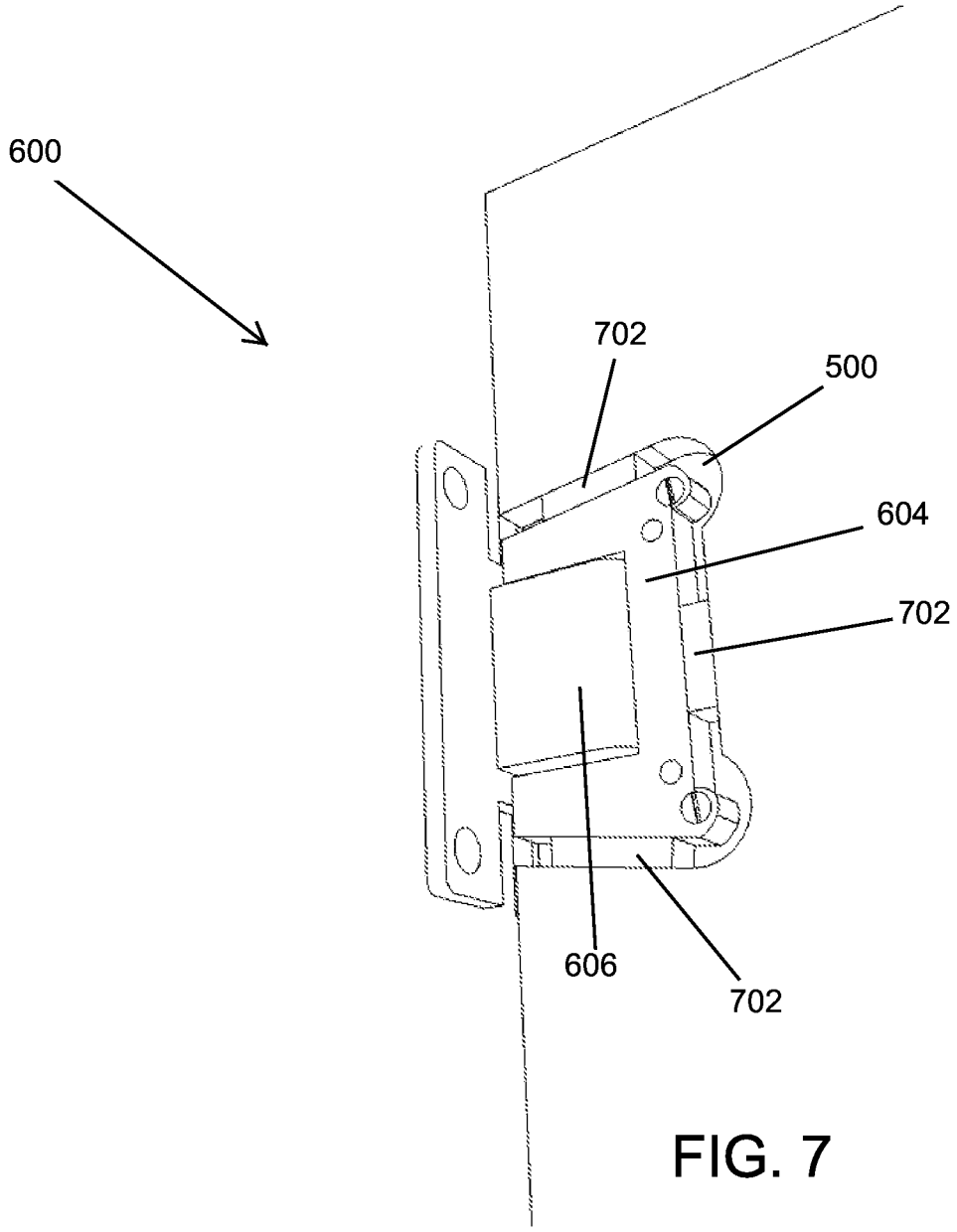
FIG. 7 is a side perspective view of a hinge with the raised central portion of one face plate containing the hinge mechanism made in a dovetail shape, engaged within a dovetail notch in a glass door and secured by shims.
Figure 8:
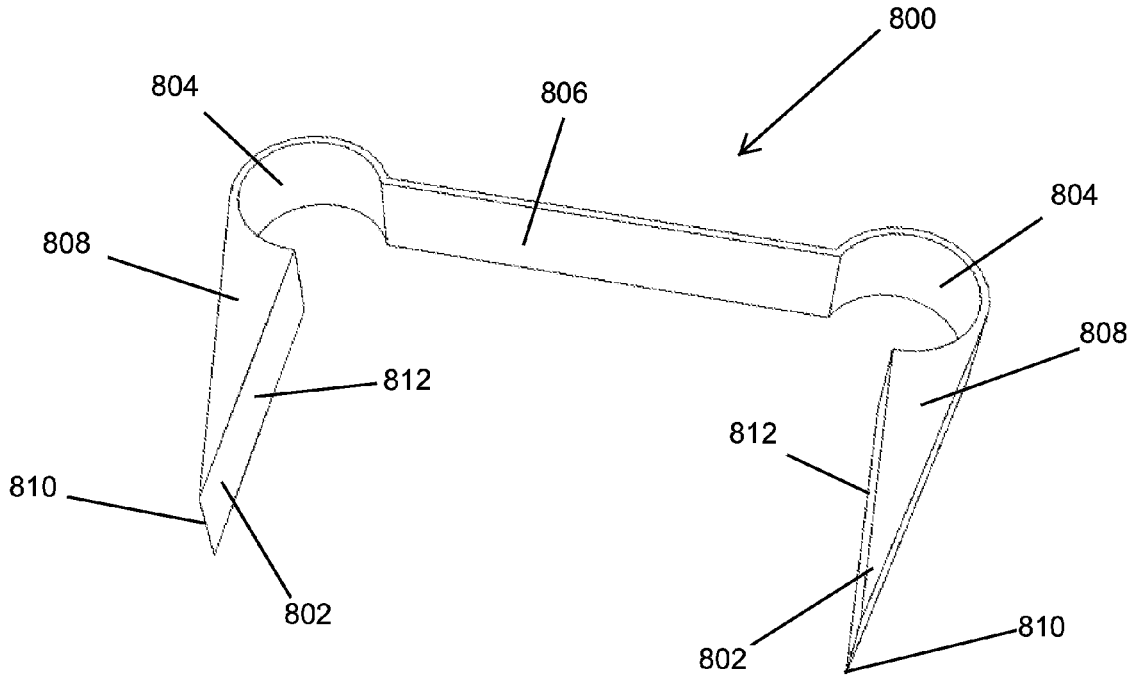
FIG. 8 is a side perspective view of an example of an insert used to secure a standard glass door hinge manufactured in accordance with prior art within a dovetail notch cut into a glass door.
Figure 9:
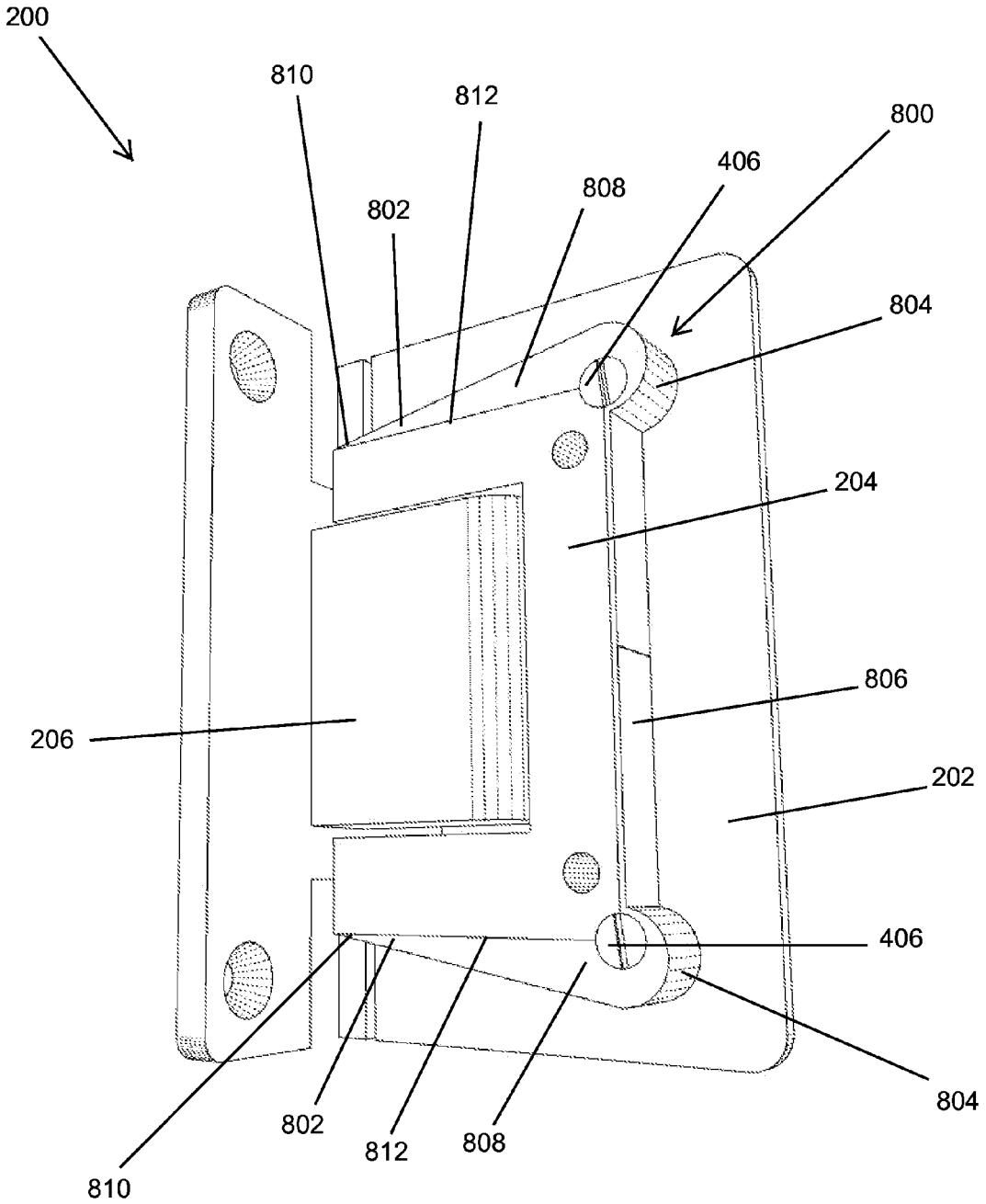
FIG. 9 is a side perspective view of one example of a standard glass door hinge manufactured in accordance with prior art with the raised central portion of one face plate given a dovetail shape by means of the insert of FIG. 8.
Figure 10:
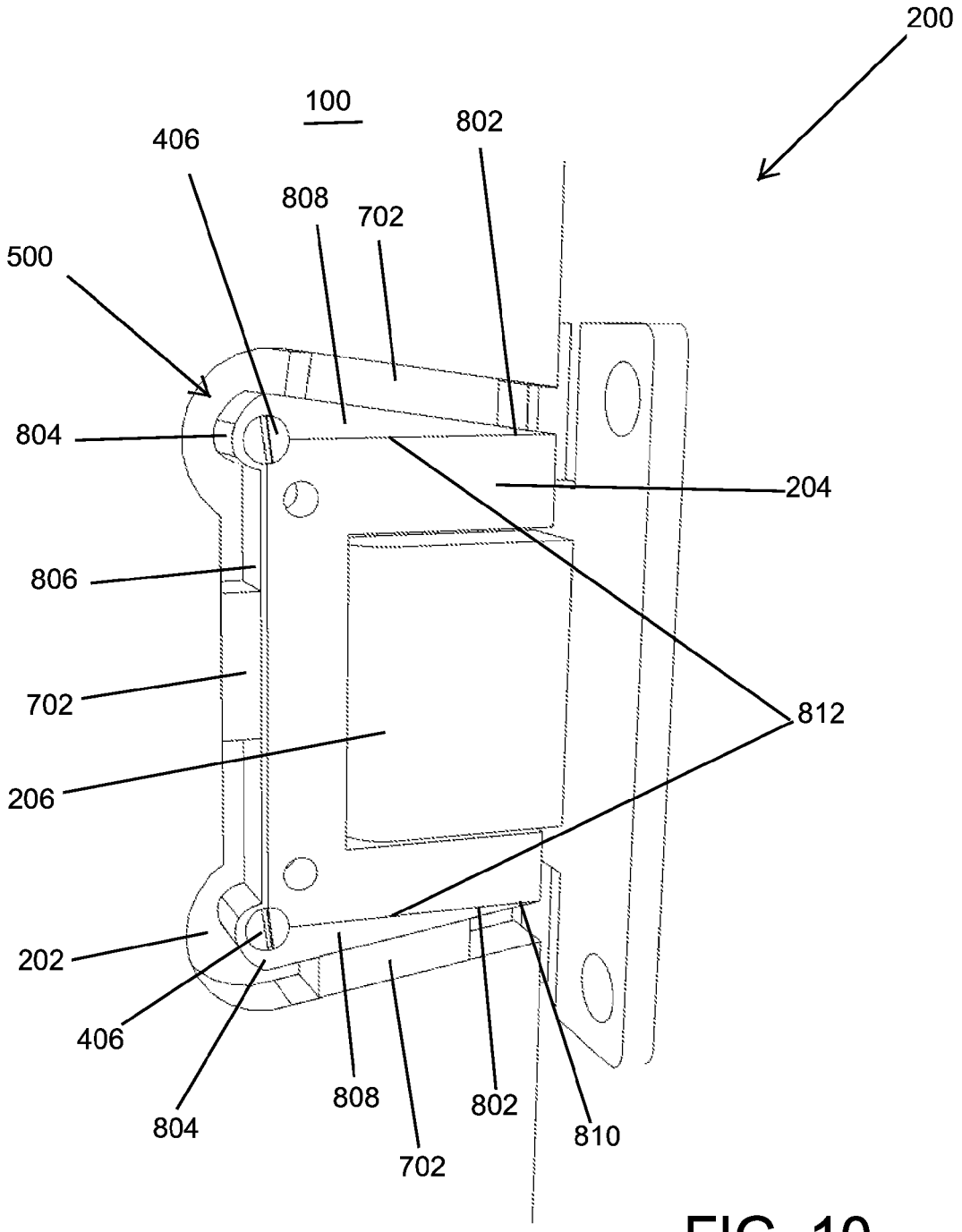
FIG. 10 is a side perspective view of one example of a standard glass door hinge manufactured in accordance with prior art with the raised central portion of one face plate given a dovetail shape by means of the insert of FIG. 8, engaged within a dovetail notch cut into a glass door and secured by additional shims.
Figure 11:
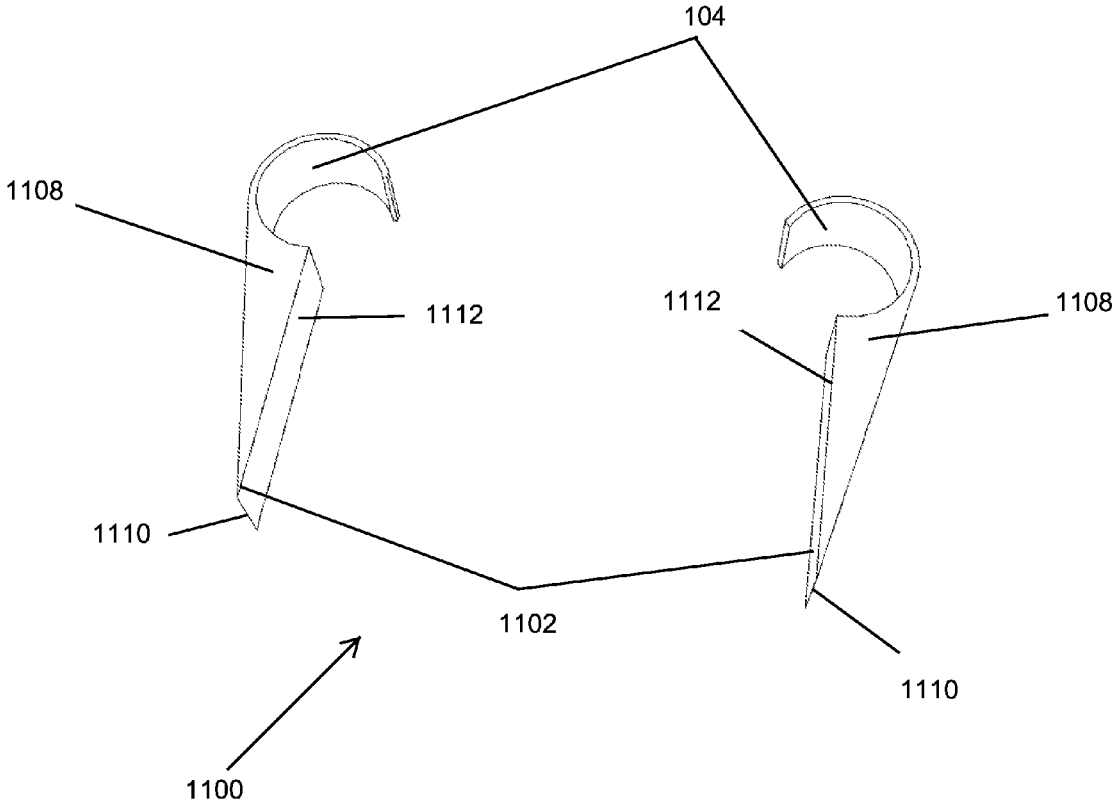
FIG. 11 is a side perspective view of another example of inserts used to secure a standard glass door hinge manufactured in accordance with prior art when engaged within a notch cut into a glass door.
Figure 12:
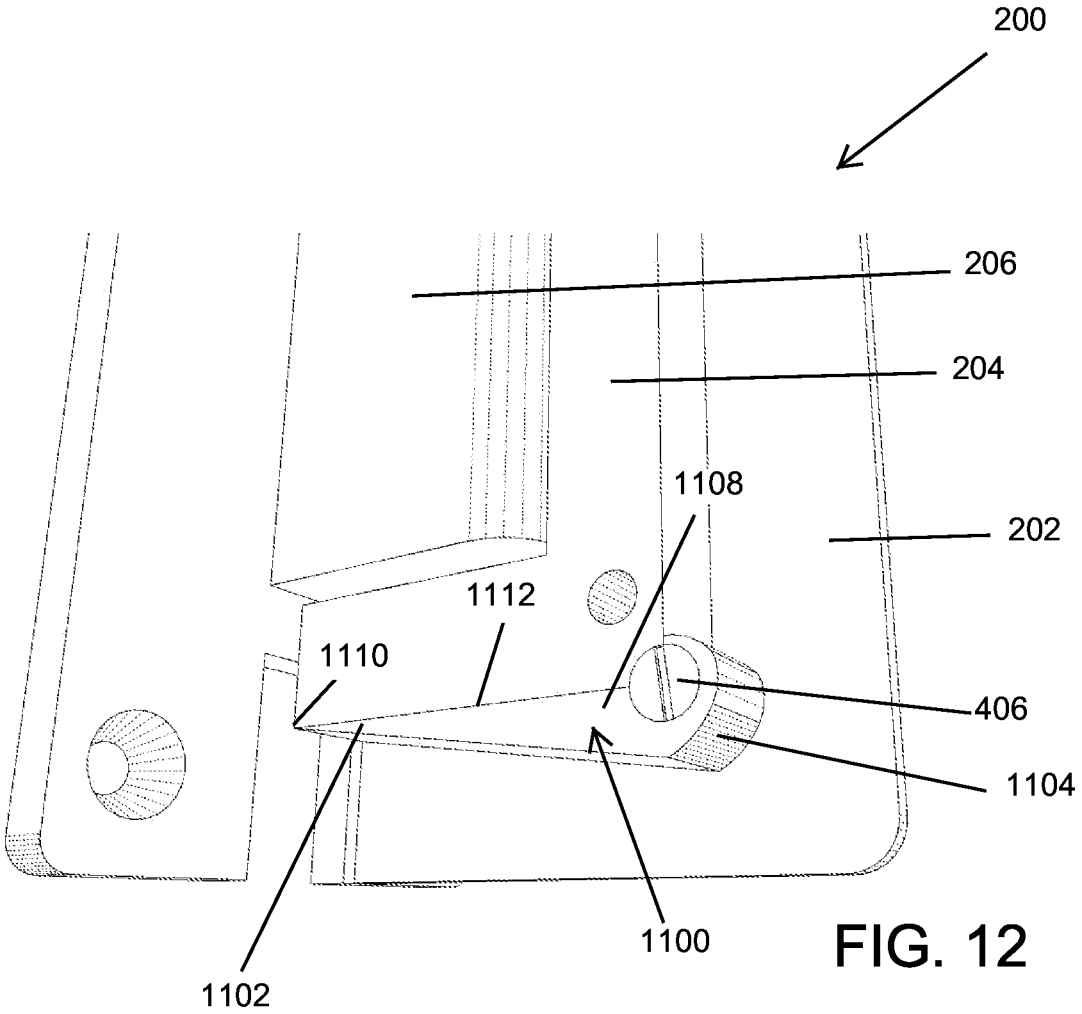
FIG. 12 is a side perspective view of a portion of a standard glass door hinge manufactured in accordance with prior art with one of the inserts of FIG. 10 engaged against one side of the raised central portion of one face plate containing the hinge mechanism.
Figure 13:
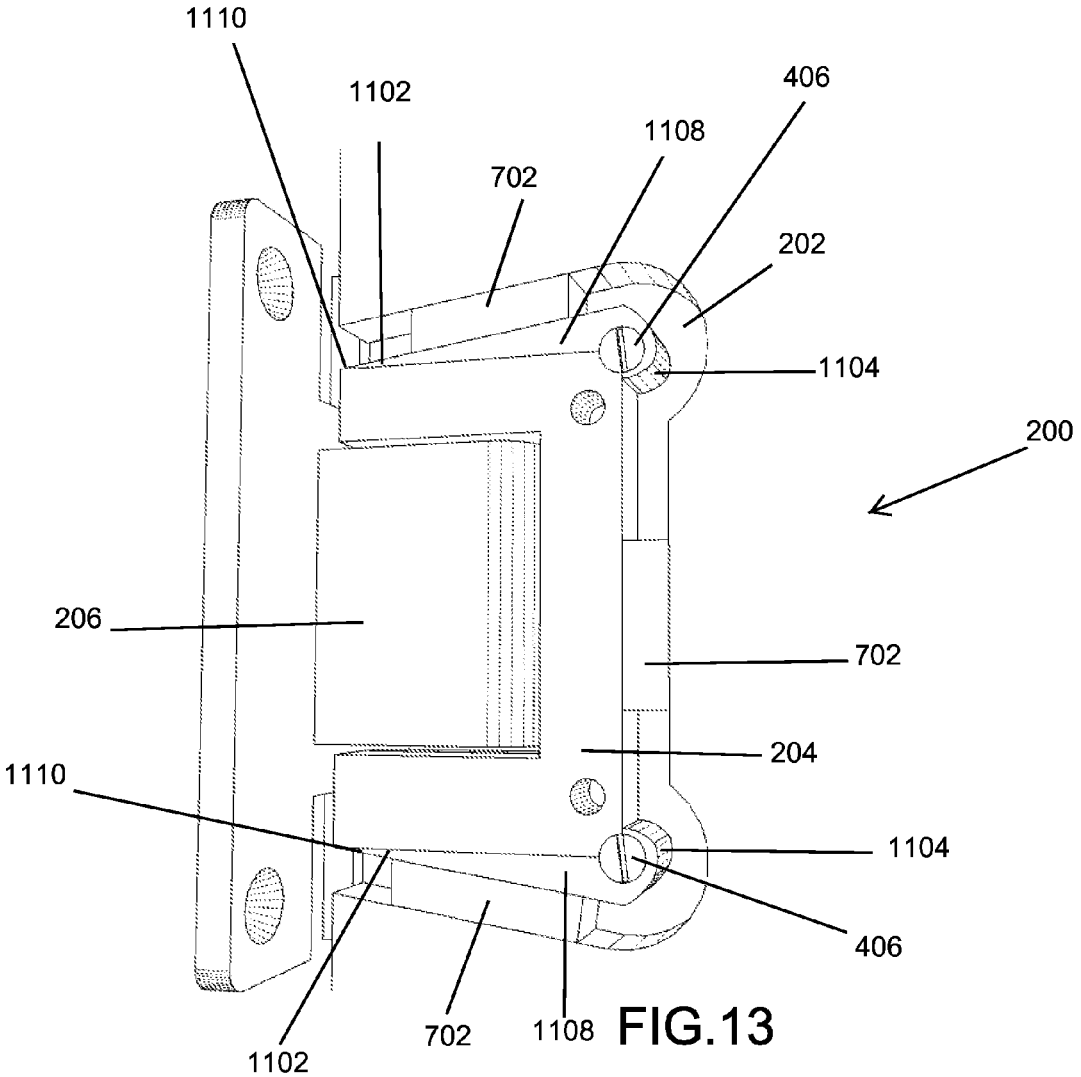
FIG. 13 is a side perspective view of an example of a standard glass door hinge manufactured in accordance with prior art with the inserts of FIG. 11, all engaged within a dovetail notch cut into a glass door and secured by additional shims.
Figure 14:
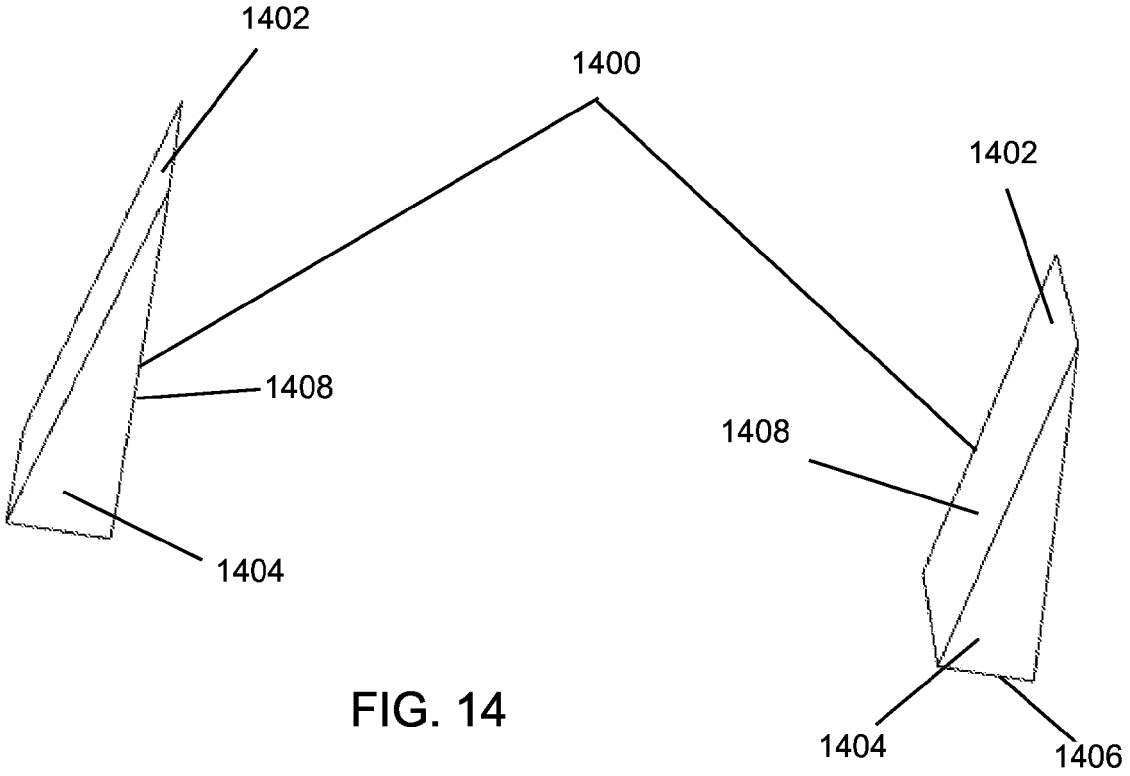
FIG. 14 is a side perspective view of another example of inserts used to secure a standard glass door hinge manufactured in accordance with prior art when engaged within a notch cut into a glass door.
Figure 15:
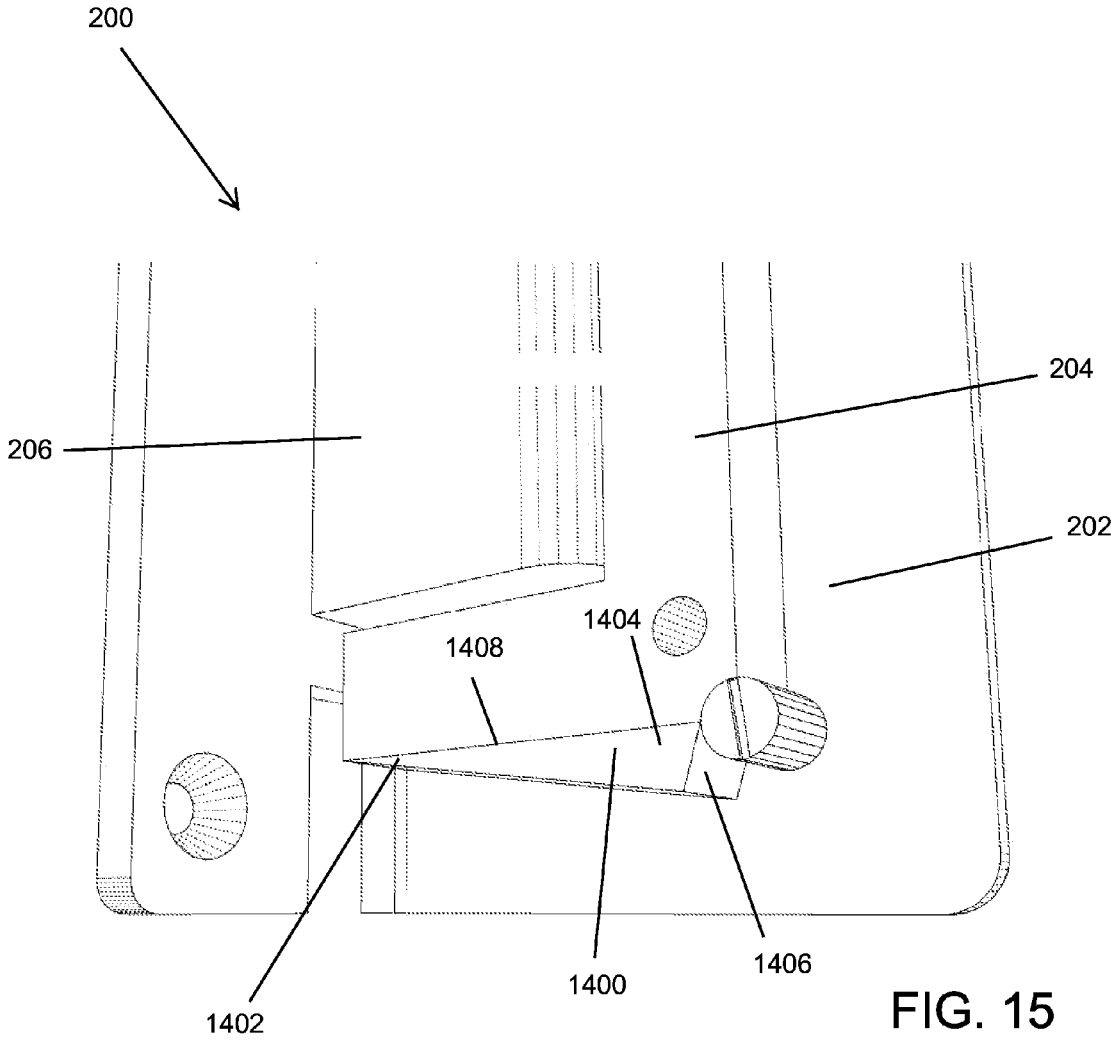
FIG. 15 is a side perspective view of a portion of a standard glass door hinge manufactured in accordance with prior art with one of the inserts of FIG. 13 engaged against one side of the raised central portion of one face plate containing the hinge mechanism.
Figure 16:
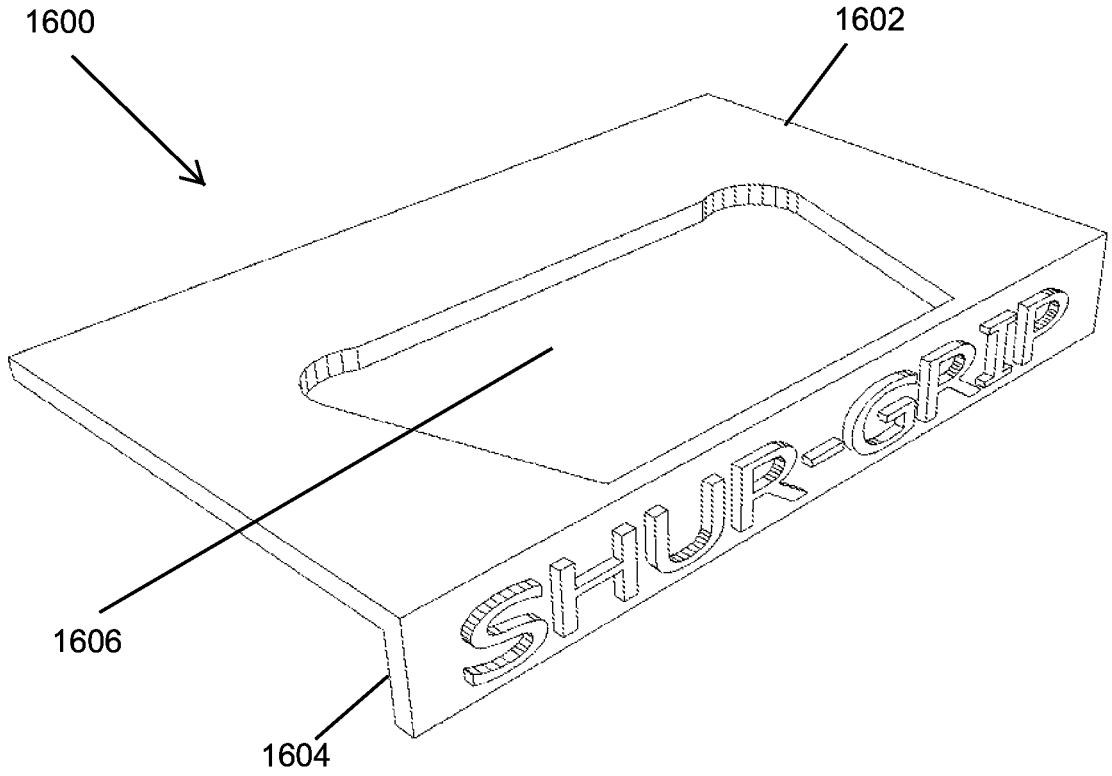
FIG. 16 is a side perspective view of an example of a template used to facilitate the cutting of a dovetail notch in a glass door.

Turning to the figures, FIG. 5 illustrates an example of the dovetail opening in the glass. FIGS. 6 and 7 describe a possible hinge for use in connection with the present invention. FIGS. 8-10 illustrate a possible insert that may be used to modify existing hinge designs for use in connection with the invention. FIGS. 11-13 provide another example of an implementation of an insert that may be used to modify the existing hinge design for use in connection with the invention. FIGS. 14 and 15 provide yet another example of an implementation of an insert that may be used to modify the existing hinge design for use in connection with the invention. Further, FIG. 16 illustrates one example of a template that facilitates the cutting of a dovetail notch in a piece of glass.

As illustrated in FIG. 5, the door 100 is cut to have an opening 500 designed to receive a hinge 200 such that the interior height A of the opening 500 is greater than the height B of the opening 500. The top and bottom of the opening taper such that the height of the opening 500 increases as the opening moves toward the center of the glass door 100. For purposes of the application, the shape of this opening 500 is referred to a "dovetail opening" or "dovetail notch."

FIG. 6 is a side perspective view of one example of a glass door hinge 100 that may be used in connection with the present invention. While like the prior art hinges in other respects, the hinge 600 is designed to have a dovetail shaped raised central portion 604 containing the hinge mechanism 606. The dovetail opening 500 in the glass 100 is then cut to be slightly larger than the raised central portion 604 of the hinge 600 to allow for adjustment during installation. The dovetail-shaped raised central area 606 fits within the notch 500 cut into a glass door or plate 100. Because of the dovetail shape of both the notch 500 and the raised central portion 606 of the hinge 600, the hinge 600 is prevented from being removed or pulled from the opening or notch 500 of the door 100 through the edge of opening (i.e., pulled out in direct alignment with the door 100). This helps prevent slippage between the hinge 600 and door 100 better securing the alignment of the door 100 once installed.

Once properly aligned, the door hinge 600 may be secured within the opening 500 by inserting shims 702 between the sides of the central raised portion 604 and the sides of the opening 500 in the door 100, as illustrated by FIG. 7. These shims may be of varying length and width as required to align the door and secure the hinge 600 within the opening 500.

Optionally, rather than creating hinges 600 with dovetail-shaped central openings 604, the shape of the central raised portions 204 in the prior art hinges 200 may be modified by inserts, as illustrated in FIGS. 8-16. The inserts may attach or be secured on or around the central raised portion 204 of the hinge 200. The inserts are designed such that when they are inserted on or around the central raised portion 204 of the hinge 200, the central raised portions 204 of the hinges 200 have a dovetail shape.

For example, FIG. 8 illustrates an example of one type of insert 800 that may be used to create a dovetail-shaped central raised portion on a hinge 200. The insert 800 may be made of any resistant material (with plastic being optimal) and formed to fit around three of the four interconnected sides of the central raised portion 204. The insert 800 includes opposing wedged portions 802 joined at their tops by rounded connections 804 designed to fit around the corner openings 406 in the raised central member 204 for receiving fasteners. The rounded connection 804 may be secured to one another by a connection piece 806 that maintains the wedged portions 802 in space relation from one another. The wedged portions are thicker at one end 808 and converge towards a point on the other end 810, such that an angle or wedge is created when one side of the wedge 812 is positioned flat against the side of the central raised portion 204.

FIG. 9 illustrates the insert 800 engaged around the raised central portion 204 of a hinge 200 containing the hinge mechanism itself 206 located on one of the hinge's face plates 202. The hinge 200 is manufactured in accordance with prior art (i.e. with the raised central portion 202 not made in a dovetail shape). As illustrated in FIG. 9, the insert 800 engages around the three outer sides of the raised central portion 204. The shorter, opposing sides of the insert 802 are formed as triangular or wedged solids that are thicker at the top 808 than at the bottom 810 so that the inner face of the insert 812 lies flat against the sides of the raised central portion 204. The insert, when engaged, produces a dovetail configuration on the sides of the raised central portion of the hinge 204 because of the insert's being wider at the top 808 than at the bottom 810.

FIG. 10 illustrates the insert 800 engaged around the raised central portion 204 of a hinge 200 containing the hinge mechanism 206 on the hinge's face plate 202. FIG. 10 illustrates the use of shims 702 to secure the hinge 202 with the insert 800 in the notch or opening 500 in the glass 100.

FIG. 11 illustrates another example of inserts 1100 that may also be used to secure a hinge 200 manufactured in accordance with prior art (i.e. with the raised central portion 204 containing the hinge mechanism itself 206 not made in a dovetail shape) within the notch 500 of a glass door 100. The inserts 1100 may be made of any resistant material (with plastic being optimal) and formed into a triangular or wedged shaped solid 1102 with a rounded, semi-circular top 1104 that may be engaged around the similarly-configured rounded corners of the central raised portion 204 of the hinge 200. The insert 1100 is thicker at the top 1108 than at the bottom 1100 so that the inner face of the shim's side 1112 lies flat against the raised central portion 204 when installed, giving the central raised portion 204 of the hinge 200 a dovetail shape.

FIG. 12 the use of the inserts 1100 engaged around the rounded corners of the central raised portion 204 of the hinge 200. The inserts, when engaged, produce a dovetail configuration on the sides of the raised central portion 204 of the hinge 200 because of the inserts 1100 being wider at the top 1108 than at the bottom 1102. FIG. 13 illustrates the inserts 1100 engaged within a notch 500 in a glass 100 door cut in a dovetail shape, further secured in place by three additional shims 702.

FIG. 14 illustrates yet another example of a type of insert 1400 that may also be used to secure a hinge 200 manufactured in accordance with prior art (i.e. with the raised central portion 204 containing the hinge mechanism itself 206 not made in a dovetail shape) within the notch 500 of a glass door 100. The inserts 1400 may be made of any resistant material (with plastic being optimal) and formed into a triangular or wedged shaped solid, which engages adjacent to the sides of the raised central portion 204. The inserts 1400 are thicker at the top 1404 than at the bottom 1402, so that the face 1408 of the insert lies flat against the raised central portion 204 forming a dovetail shape on the sides of the central portion 204.

In this example, as with the other examples, the inserts include general wedged or triangular shaped having a thickness at the top 1406 of approximately ⅛ to ½" inches wide that reduces to zero at the opposing as the sides converge. The sides 1408 may be approximately 0.5"-2.5" inches (or 1-2" inches) in length.

FIG. 15 illustrates the inserts 1400 engaged adjacent to one side of the raised central portion 204 of a hinge 200 containing the hinge mechanism 206 on the hinge's face plates 202 manufactured in accordance with prior art (i.e. with the raised central portion 204 not made in a dovetail shape). The inserts 1400, when engaged, produces a dovetail configuration on the side of the raised central portion 204 by means of the inserts 1400 being wider at the top 1404 than at the bottom 1402.

FIG. 16 is a side perspective view of one example of a template 1600 that can be used to facilitate the cutting of a dovetail notch 500, 1606 in a frameless glass door or panel 100. The template consists of a rectangular piece of material 1602, having a bend at one end 1604, which is bent at a 90 degree angle from the main plane of the template 1600. The template can be made of plastic, metal or other hard material. The template contains a dovetail-shaped opening 500, 1606. In operation, the template 1600 is laid upon the edge of the glass 100 that is to be cut, and moved perpendicular to the edge until the part of the template that is bent 90 degrees is flush against the side of the glass 100. The opening is then cut into the glass 100 in accordance with opening 500, 1606 of the template 1600.

A method for securing and preserving the alignment of frameless glass doors, such as shower doors, during and after installation is also provided by the present invention. The method includes the steps of cutting each notch in the glass within which the door hinges are mounted in a dovetail shape, and fitting these notches with hinges that are either manufactured so that the portion of the hinge that is engaged within the notch is itself dovetail shaped, which portion is then engaged within the dovetail-shaped notch and secured by shims of even thickness, or alternatively is a hinge manufactured according to prior art 200, where the shape of the portion of the hinge that is engaged within the notch is modified to a dovetail shape using inserts of uneven thickness, which modified portion is then engaged within the notch and secured by additional shims of even thickness.

Those skilled in the art will recognize that other possible implementations and variations may be designed and utilized without departing from the scope of the invention. For example, other insert types may be used without departing from the scope of the invention. Cam may be used to secure and align prior art hinges within dovetail shaped openings or within traditional shaped openings cut into the glass. Further, inserts of other sizes and shapes may be used alone or in conjunction with shims of various sizes and shapes (and not just shims of even thickness). Other shapes for the raised central portion and/or the opening or notch in the panel or the door may also be used without departing from the scope of the invention, for example a modified or partial dovetail may be used (e.g., dovetail or angled cut-out or shape on only side) without departing from the scope of the invention. Further, while the invention is taught for use in conjunction with frameless showers doors, those skilled in the art will recognize that it may be utilized in connection with any hinge that connects to the door or panel by compression between two plates.

It is also within the scope of the presenting invention to use a hinge adjustment/locking device comprised of a cam, wedge, spring or other means for engaging the hinge body directly to the panel, locking it in place, without relying solely on the clamping pressure of the cover to the hinge body. Other hinge adjustments/locking devices that allow the raised portion of the hinge to engage the edge of the cut-out will help prevent slippage present in the current designs.

The foregoing description of an implementation has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. An insert for modifying the shape of a central raised portion in a door hinge where the central raised portion of the door hinge has rounded interior corners, the insert comprising at least two wedged members each having a thick end, a thin end and a cross-section spanning between the thick and thin end that is triangular in shape, where the triangular shape has a short leg, a long leg and a hypotenuse and further including a rounded connection extending tangentially from the hypotenuse of the triangle at the thick end of the wedged member, the rounded connection for engaging the rounded interior corners of the central raised portion of the door hinge and a connection piece spanning between the rounded connections of each wedged member for maintain the wedged members in spaced relationship to one another where the long legs of the triangles of each wedged member are positioned perpendicular to the connection piece.

2. The insert of claim 1 where the two wedged members are spaced apart from one another in opposing mirrored relationship to one another, and where each wedged member is of the same size.

3. The insert of claim 1 where the connection piece connects to the rounded connections of each wedged member.

4. A device for minimizing slippage between a hinge that engages a door or panel by compressing the door between two plates of the hinge where at least one plate of the hinge includes a central raised portion having interior corners and generally flat, parallel upper and lower sides perpendicular to the at least one plate, the device comprising opposing wedged members having interior and exterior sides, where the interior sides are positioned in opposing parallel relationship to one another to extend along opposing flat sides of the upper or lower sides of the central raised portion of the hinge, the wedged members each being tapered from one end of the wedged member to another such that one end of each wedged member is thicker than the other end and further includes a hinge engaging member extending tangentially from the exterior side of the wedged member at its thicker end of the wedged member for engaging the interior corners on the central raised portion of the door hinge.

5. The device of claim 4 where the two wedged members are connected by a connection piece that extends between the hinge engaging members of the two wedged members and maintains the two wedged members in spaced relationship to one another.

* * * * *